US006140751A

United States Patent [19]

Hammer et al.

[11] Patent Number: 6,140,751

[45] Date of Patent: Oct. 31, 2000

[54] ELECTROLYTIC CAPACITOR HEAT SINK

[75] Inventors: Edward E. Hammer, Mayfield Village; Alvin A. Bush, South Euclid, both of Ohio

[73] Assignee: General Electric Company, Schenectady, N.Y.

[21] Appl. No.: 09/050,312

[22] Filed: Mar. 30, 1998

[51] Int. Cl.[7] ..... H01J 1/02; H01J 61/52; H01J 7/24; H01K 1/58

[52] U.S. Cl. ..... 313/46; 313/44; 313/47; 313/51; 315/56; 315/57; 315/58

[58] Field of Search ..... 313/44, 46, 47, 313/51, 317, 318.01, 318.06, 318.08, 318.09, 318.12; 315/56, 57, 58, 59, 61, 62

[56] References Cited

U.S. PATENT DOCUMENTS

| | | | |
|---|---|---|---|
| 3,936,686 | 2/1976 | Moore | 313/46 |
| 4,258,287 | 3/1981 | Hetzel | 313/51 |
| 4,503,358 | 3/1985 | Kamei et al. | 315/58 |

FOREIGN PATENT DOCUMENTS

| | | | |
|---|---|---|---|
| 2095464 | 9/1982 | United Kingdom | 313/44 |

*Primary Examiner*—Michael H. Day
*Assistant Examiner*—Mariceli Santiago
*Attorney, Agent, or Firm*—Fay, Sharpe, Fagan, Minnich & McKee, LLP

[57] ABSTRACT

A light source system includes a heat sink. A base connector receives electrical power. A housing is secured to the base connector. A ballast unit is secured within the housing and electrically connected to the base connector. At least one electrical component is both mechanically and electrically connected to the ballast unit. The at least one electrical component is driven by the electrical power received by the base connector. A lamp unit is secured to the housing and electrically connected to the ballast unit. An additional electrical component includes a portion which contacts an inside wall of the housing. The additional electrical component is electrically connected to the ballast unit and has a life span which decreases as an operating temperature of the additional electrical component increases. The inside wall of the housing acts as the heat sink for the additional electrical component. The operating temperature of the additional electrical component is reduced by dissipating heat from the additional electrical component via the portion contacting the inside wall of the housing.

19 Claims, 2 Drawing Sheets

ELECTROLYTIC CAPACITOR HEAT SINK

BACKGROUND OF THE INVENTION

The present invention relates to compact fluorescent lamp systems. It finds particular application in conjunction with extending the life of a ballast unit within a compact fluorescent lamp system operated within an enclosed environment and will be described with particular reference thereto. It will be appreciated, however, that the invention will also find application in extending the life of ballast units in other types of fluorescent lamp systems.

In general, compact fluorescent lamps are manufactured as either integral or plug-in type systems. Both types of compact fluorescent lamp systems require the use of a ballast unit in conjunction with a lamp. Lamps in integral type systems are permanently connected to the ballast unit. Lamps in plug-in type systems, on the other hand, are removably connected to an external ballast unit. When either the lamp or the ballast unit in an integral type system reaches the end of its life, the entire system of lamp and ballast unit must be discarded. However, when a lamp in a plug-in type system expires, the lamp may simply be replaced. In either case, it is desirable that the ballast unit have a longer life than the lamp in order to insure the rated lamp life will be achieved.

The life of the ballast unit is often limited by the life of one of its most susceptible components (i.e., an electrolytic capacitor). The life of the electrolytic capacitor is a strong function of the temperature at which it operates. More specifically, the life of the electrolytic capacitor is lessened when it is operated at elevated temperatures. The electrolytic capacitor itself does not generate much heat while the fluorescent lamp system is operating. However, the fluorescent lamp and many of the other components within the ballast unit do not run as cool as the electrolytic capacitor. Therefore, heat generated by the lamp and these other component parts of the ballast unit tend to externally raise the temperature at which the electrolytic capacitor operates. Therefore, the heat generated by the operation of the lamp can negatively affect the life of the electrolytic capacitor and, consequently, the operation and life of the ballast unit. Conversely, it becomes apparent that operating the electrolytic capacitor at a lower temperature lengthens the life span of the ballast unit, particularly when the limiting factor is the electrolytic capacitor itself.

Fluorescent lamp systems have traditionally been manufactured using linear lamps electrically connected to a remote ballast unit and then installed in a fixture. Ballast units used with linear fluorescent lamp systems have a significant amount of their surface areas exposed to a relatively cool ambient air. Therefore, heat generated in these ballast units used with linear fluorescent lamps is more easily dissipated so that the ballast unit, and its electrolytic capacitor within the ballast unit, run substantially cooler. As described above, cooler running ballast units typically have longer life spans. In fact, the life span of a ballast unit used with a linear fluorescent lamp operated in normal application environments can be in the order of 100,000 hours. As contrasted, the life span of the lamp used in a linear system operated in typical environment is traditionally much shorter than that of the ballast unit. Therefore, the life span of the linear fluorescent lamp system is typically limited by the life of the lamp.

It is frequently desirable to operate fluorescent lamp systems in an enclosed environment. Because the system is not exposed to as much circulating cool air when it is used under such conditions, less heat is dissipated by convection and conduction, thereby raising the operating temperature of the ballast unit and shortening its life. For example, the life of the ballast unit used with a linear fluorescent lamp operating in an enclosed environment is reduced from approximately 100,000 hours to approximately 60,000 hours. Although this can represent a significant reduction in the life of that ballast unit, the life span of the ballast unit is still much longer than that of the lamp so that the system life is still determined by the life of the fluorescent lamp.

In order for compact fluorescent lamps operating in an open environment to deliver a life rating of 10,000 hours, the associated ballast unit life typically must be about 40,000 hours. Therefore, as in linear fluorescent lamp systems, it is desirable that the life span of a ballast unit used with a compact fluorescent lamp operating in any environment be much longer than the life span of that lamp.

A noticeable decrease in the life span of a ballast unit occurs in compact fluorescent lamp systems operated in an enclosed environment and, consequently, at elevated temperatures. More specifically, the life of the ballast unit in integral compact fluorescent lamp systems operated in an enclosed environment may be as short as 3,000 hours to 5,000 hours. Therefore, it is not uncommon for the life of ballast units in integral compact fluorescent lamp systems to be shorter than the life span of the lamp itself. As stated above, such a condition is grossly undesirable.

The inherent compressed design of the integral compact fluorescent lamp system makes it difficult to operate an enclosed ballast unit at lower, more desirable temperature conditions because of the stagnant air atmosphere surrounding the enclosed ballast unit assembly. Consequently, it is difficult to achieve the rated life of the ballast unit used within a compact fluorescent lamp, and functioning in an enclosed environment.

It is possible to incorporate electrolytic capacitors which have longer lives even when they operate at higher system ambient temperatures. However, these electrolytic capacitors are more expensive than traditional capacitors and, therefore, substantially increase the manufacturing cost of the assembled ballast unit used with the compact fluorescent lamp.

The present invention discloses a unique approach to achieve the improved performance and describes the technical explanation of how this new device overcomes the above-referenced problems and others.

SUMMARY OF THE INVENTION

A lamp system includes a housing and a base connector. The base connector is mounted in a wall of the housing and receives electrical power. A ballast unit is secured within the housing and electrically connected to the base connector. A lamp unit is secured to the housing and electrically connected to the ballast unit. At least one electrical component is both mechanically and electrically connected to the ballast unit. The at least one electrical component is driven by the electrical power received by the base connector. An independent electrical component has a life span which decreases as an operating temperature of the independent electrical component increases. The independent electrical component is electrically connected to the ballast unit. The independent electrical component is positioned to create a thermal conductive path between the independent electrical component and a wall of the housing. The housing acts as the heat sink for the independent electrical component.

In accordance with one aspect of the invention, the independent electrical component is an electrolytic capacitor.

In accordance with another aspect of the invention, the thermal conductive path is defined by a portion of the independent electrical component, which at least one of vents and absorbs heat, contacting the wall of the housing.

In accordance with another aspect of the invention, the lamp unit is a fluorescent lamp unit.

In accordance with another aspect of the invention, the heat dissipated from the independent electrical component includes at least one of heat generated by the independent electrical component, heat generated by the fluorescent lamp unit and absorbed by the independent electrical component, and heat generated by the at least one electrical component and absorbed by the independent electrical component.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
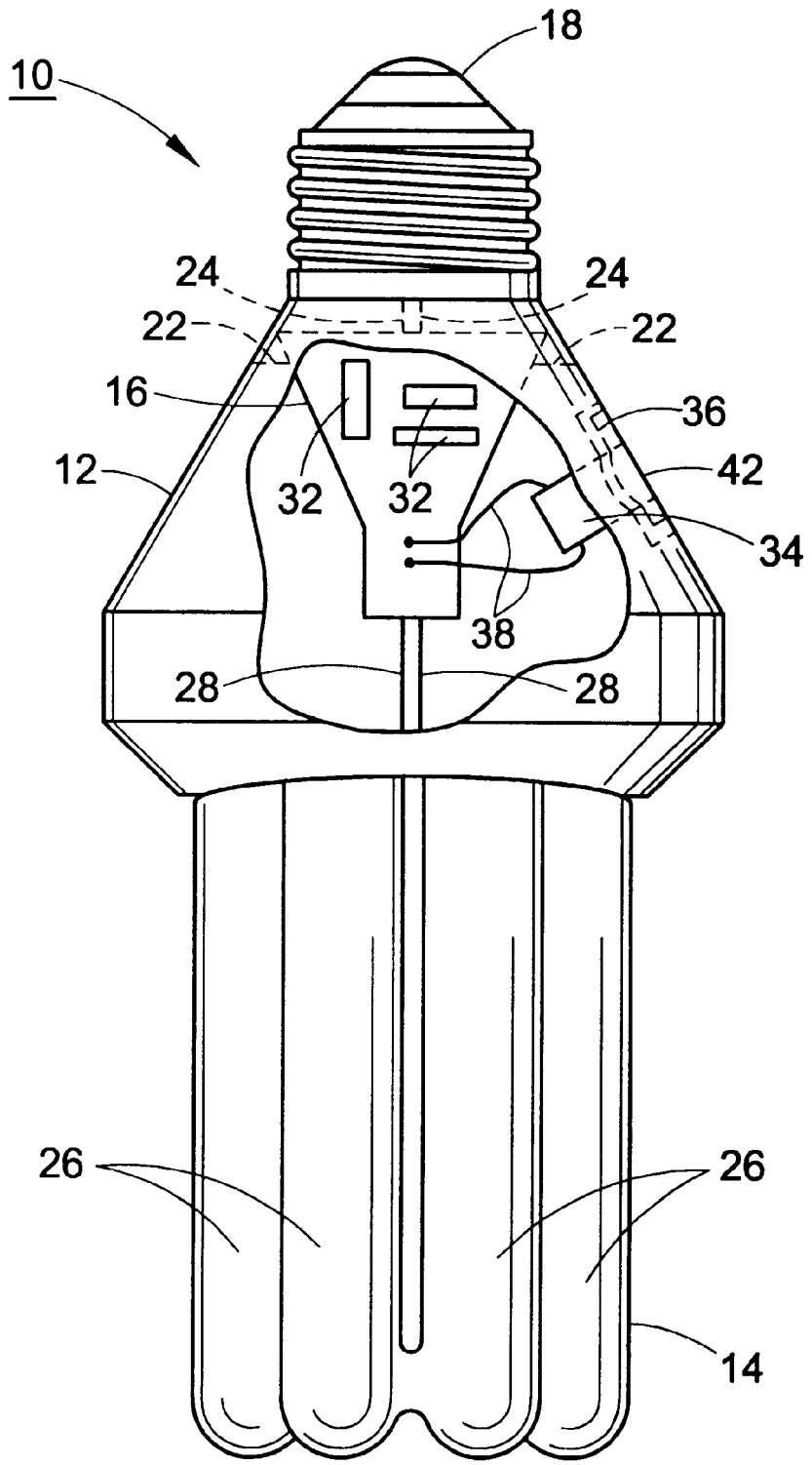
FIG. 1 illustrates a typical compact fluorescent lamp according to the present invention in which the electrolytic capacitor contacts the inside wall of the housing and is physically displaced from, but still a functional part independent of, the ballast unit.

FIG. 1 illustrates a compact fluorescent lamp system 10. The compact fluorescent lamp system 10 includes a housing 12 and a lamp assembly 14. The housing 12 includes a ballast unit 16 and a connection base 18. Fasteners 22 secure the ballast unit 16 to the housing 12. Preferably, the fasteners 22 include plastic segments which protrude from the walls of the housing 12 and attach to the ballast unit 16. However, it is to be understood that other types of fasteners are also contemplated. Preferably, the connection base 18 is an Edison base as used in threaded incandescent sockets. However, it is also contemplated that the connection base be a pin base, as used in a linear fluorescent lamp, or a bayonet type. Wires 24 provide an electrical connection between the connection base 18 and the ballast unit 16.

In the embodiment shown in FIG. 1, the lamp assembly 14 includes one or more lamp tubes 26 preferably in a bent and bridged design configuration. The lamp assembly 14 is connected to the ballast unit 16 through electrical connections 28 in the housing 12. During use, electrical power enters the compact fluorescent lamp system 10 through the connection base 18, is delivered to the ballast unit 16 through the wires 24, and then to the lamp assembly 14 through the electrical connections 28.

Various electrical components 32 are mounted on the ballast unit 16. An electrolytic capacitor 34, electrically connected to the ballast unit 16 through capacitor wires 38, is positioned in the housing 12 such that a thermally conductive path is created between the electrolytic capacitor 34 and a wall of the housing 12. The electrolytic capacitor 34 is secured to a wall of the housing 12 by means of a clip 36. During operation of the compact fluorescent lamp 10, heat generated by the lamp assembly 14 enters the housing 12. Even more heat from the lamp assembly 14 transfers into the housing 12 if the compact fluorescent lamp system 10 is operated in a base-up configuration and/or inside an enclosed environment. Heat generated by the other electrical components 32 also raise the temperature in the inside of the housing 12. While the lamp system 10 is operated, the electrolytic capacitor 34 typically generates significantly less heat than the lamp assembly 14 and/or the other electrical components 32.

In general, an electrolytic capacitor is designed to vent heat through one of its ends (i.e., the heat dissipating end). If the temperature of the area around the heat dissipating end of the electrolytic capacitor is raised by some external heat source, such as another electric component, the capacitor will absorb this heat. Consequently, the temperature at which the electrolytic capacitor operates will rise.

In the preferred embodiment illustrated in FIG. 1, the electrolytic capacitor 34 is secured in the clip 36 such that its heat dissipating end 42 contacts an inside wall of the housing 12. Therefore, the thermally conductive path is created between the heat dissipating end 42 and the inside wall of the housing 12. The wall acts as a heat sink for the electrolytic capacitor 34. More specifically, heat vented through the heat dissipating end 42 of the electrolytic capacitor 34 is exhausted, via the wall, to the outside of the housing 12. In this manner, the temperature of the heat dissipating end 42 is maintained at a low enough level to allow the electrolytic capacitor 34 to vent heat. Consequently, the electrolytic capacitor 34 runs cooler, thereby prolonging the life of the electrolytic capacitor 34 and the ballast unit 16.

While the preferred embodiment illustrated in FIG. 1 discloses the heat dissipating end 42 of the electrolytic capacitor 34 contacting the inside wall of the housing 12, it is to be understood that other embodiments are also contemplated. For example, it is also contemplated that the thermally conductive path be created by contacting any portion, not necessarily the heat dissipating end, of the electrolytic capacitor to the inside wall of the housing. It is also contemplated that the thermally conductive path be created by simply placing any portion of the electrolytic capacitor close enough to the inside wall of the housing, without touching it, so that heat from the electrolytic capacitor is dissipated through the wall.

The heat dissipating end 42 of the electrolytic capacitor 34 illustrated in FIG. 1 is mounted on a side wall inside the housing 12. However, it is to be understood that the capacitor 34 can be mounted so that the heat dissipating end 42 contacts any part of the inside wall of the housing 12.

Figure 2:
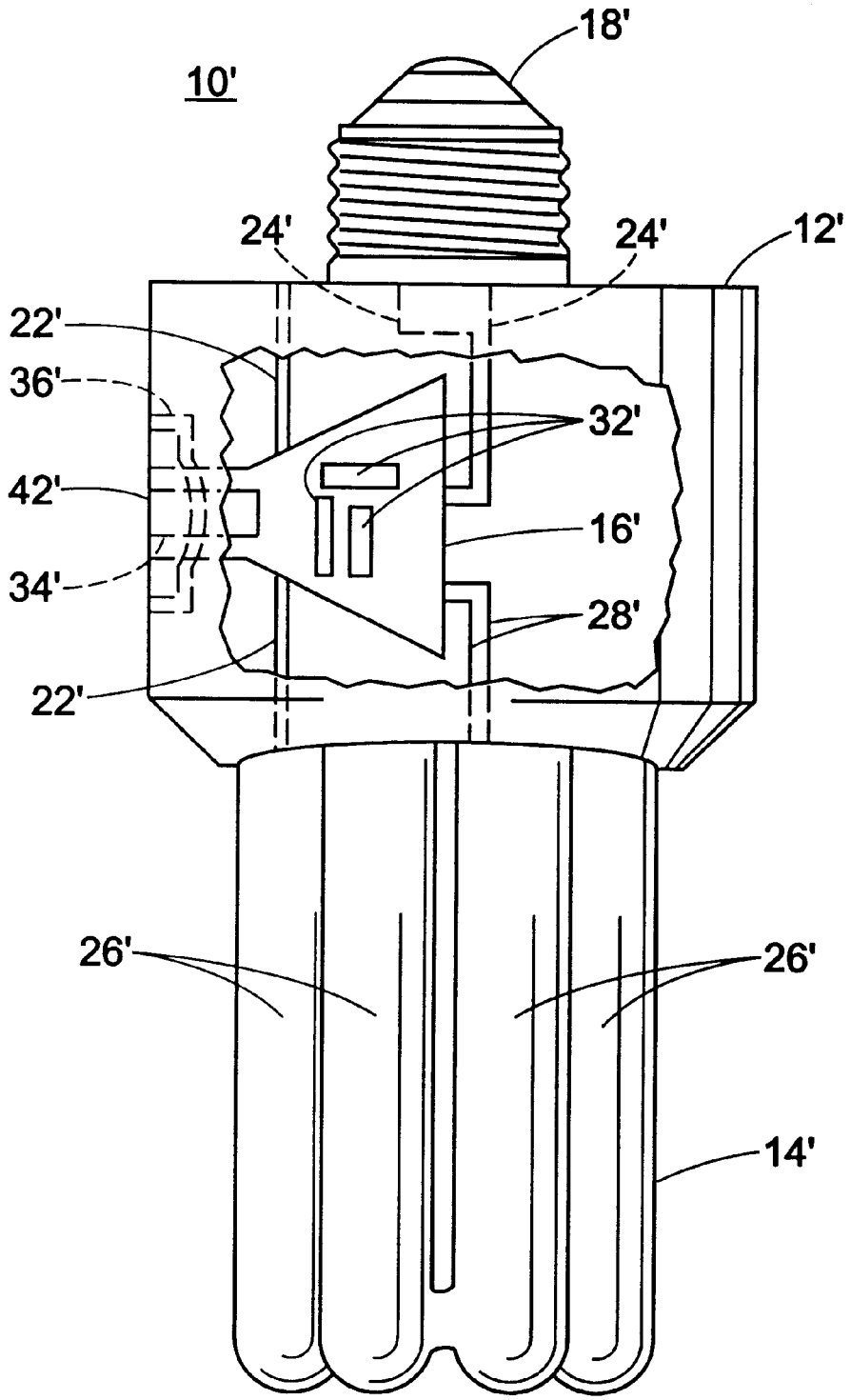
FIG. 2 illustrates an alternate embodiment of the present invention in which the electrolytic capacitor is mounted on the ballast unit and the ballast unit is positioned such that the electrolytic capacitor contacts the inside wall of the housing.

FIG. 2 illustrates an alternate embodiment of the present invention. For ease of understanding this embodiment of the present invention, like components are designated by like numerals with a primed (') suffix. In FIG. 2, the electrolytic capacitor 34' is positioned on the ballast unit 16' such that the heat dissipating end 42' extends to an edge of the ballast unit 16'. The ballast unit 161 then is positioned within the housing 12' such that the heat dissipating end 42' contacts the wall of the housing 12'. As in the first embodiment, the wall acts as a heat sink for the electrolytic capacitor 34'.

TABLES 1–3 include results from tests run using a compact fluorescent lamp system operated in a base-up configuration.

The results included in TABLE 1 are for a compact fluorescent lamp system operated in a base-up configuration and an open air environment. The electrolytic capacitor included in the system used to obtain the results in TABLE 1 were connected normally and did not contact the housing. TABLE 1 shows the operating temperature of the electrolytic capacitor in this configuration stabilized at 81.4° C.

The results included in TABLE 2 are for a compact fluorescent lamp system operated in a base-up configuration and an enclosed environment. The electrolytic capacitor included in the system used to obtain the results in TABLE 2 also did not contact the housing. TABLE 2 shows the operating temperature of the electrolytic capacitor in this configuration stabilized at 106.0° C.

TABLE 3 includes results from a test run using a similarly oriented compact fluorescent lamp system operated in an enclosed environment. The heat dissipating end of the electrolytic capacitor in this case did contact a wall of the housing. The temperature of the electrolytic capacitor in this case stabilized at only 92.0° C. Therefore, the electrolytic capacitor stabilized at a temperature 14.0° C. cooler when the capacitor contacted the wall of the housing. In general, the life of the electrolytic capacitor doubles for every 10° C. cooler at which the capacitor operates.

The maximum benefit realized by electrolytic capacitors which contact the wall of the housing disclosed in the present invention occurs when a compact fluorescent lamp system is used in a base-up configuration. However, such a design still provides significant benefits when used in compact fluorescent lamp systems oriented in horizontal configurations. Benefits have also been noted in compact fluorescent lamp systems operated in base-down configurations.

TABLE 1

| BASE UP OPEN AIR | | | | |
|---|---|---|---|---|
| TIME | VOLTS | mA | WATTS | TEMP C |
| 7:10 AM | 230 | 106.1 | 15.8 | 38.6 |
| 8:25 AM | 230 | 106.7 | 15.8 | 80.0 |
| 9:20 AM | 230 | 106.8 | 15.8 | 81.8 |
| 10:30 AM | 230 | 106.6 | 15.8 | 81.4 |

TABLE 2

| BASE UP IN ENCLOSED CAN | | | | |
|---|---|---|---|---|
| TIME | VOLTS | mA | WATTS | TEMP C |
| 11:10 AM | 230 | 104.6 | 15.6 | 33.0 |
| 11:30 AM | 230 | 100.0 | 14.7 | 83.0 |
| 11:35 AM | 230 | 100.0 | 14.7 | 90.0 |
| 11:50 AM | 230 | 99.6 | 14.6 | 99.0 |
| 11:57 AM | 230 | 99.3 | 14.6 | 101.0 |
| 1:10 PM | 230 | 98.1 | 14.4 | 105.0 |
| 2:00 PM | 230 | 98.1 | 14.4 | 106.0 |
| 3:20 PM | 230 | 98.0 | 14.4 | 106.0 |
| 3:40 PM | 230 | 98.0 | 14.4 | 106.0 |

TABLE 3

| BASE UP IN ENCLOSED CAN WITH CAPACITOR ATTACHED TO CASE | | | | |
|---|---|---|---|---|
| TIME | VOLTS | mA | WATTS | TEMP C |
| 10:15 AM | 230 | 106.3 | 15.9 | 26.0 |
| 10:30 AM | 230 | 100.4 | 14.8 | 54.0 |
| 10:47 AM | 230 | 99.8 | 14.6 | 81.0 |
| 11:00 AM | 230 | 99.6 | 14.6 | 88.0 |

TABLE 3-continued

| BASE UP IN ENCLOSED CAN WITH CAPACITOR ATTACHED TO CASE | | | | |
|---|---|---|---|---|
| TIME | VOLTS | mA | WATTS | TEMP C |
| 11:10 AM | 230 | 98.9 | 14.5 | 90.0 |
| 11:20 AM | 230 | 98.5 | 14.4 | 91.0 |
| 11:40 AM | 230 | 98.4 | 14.4 | 91.0 |
| 12:00 PM | 230 | 98.4 | 14.4 | 91.0 |
| 1:00 PM | 230 | 98.4 | 14.4 | 92.0 |
| 2:00 PM | 230 | 98.3 | 14.4 | 92.0 |
| 3:00 PM | 230 | 98.3 | 14.4 | 92.0 |
| 4:00 PM | 230 | 98.3 | 14.4 | 92.0 |

Having thus described the preferred embodiment, the invention is now claimed to be:

1. A lamp including a heat sink system, the lamp comprising:

a housing;

a base connector, for receiving electrical power, mounted in a wall of the housing;

a ballast unit secured within the housing and electrically connected to the base connector;

a lamp unit secured to the housing and electrically connected to the ballast unit;

at least one electrical component both mechanically and electrically connected to the ballast unit, the at least one electrical component being driven by the electrical power received by the base connector; and an independent electrical component, having a life span which decreases as an operating temperature of the independent electrical component increases, electrically connected to the ballast unit, the independent electrical component being positioned to directly contact the wall of the housing to create a thermally conductive path between the independent electrical component and the wall of the housing whereby the housing is a heat sink for the independent electrical component.

2. The lamp as set forth in claim 1, wherein the thermally conductive path is defined by a portion of the independent electrical component, which at least one of vents and absorbs heat at a greater rate than other portions of the independent electrical component.

3. The lamp as set forth in claim 1, wherein the operating temperature of the independent electrical component is reduced by dissipating heat from the independent electrical component via the thermal conductive path.

4. The lamp as set forth in claim 3, wherein the heat dissipated from the independent electrical component includes at least one of heat generated by the independent electrical component, heat generated by the lamp unit and absorbed by the independent electrical component, and heat generated by the at least one electrical component and absorbed by the independent electrical component.

5. The lamp as set forth in claim 1, wherein the lamp unit is a fluorescent lamp unit.

6. The lamp as set forth in claim 5, wherein the housing and the fluorescent lamp unit form a compact fluorescent lamp system.

7. The lamp as set forth in claim 1, wherein the independent electrical component is an electrolytic capacitor.

8. The lamp as set forth in claim 1, wherein the independent electrical component is secured to the ballast unit.

9. A heat sink system for a light source, the light source including a base connector for receiving electrical power, a housing secured to the base connector, a ballast unit secured within the housing and electrically connected to the base connector, at least one electrical component both mechanically and electrically connected to the ballast unit, the at least one electrical component being driven by the electrical power received by the base connector, a lamp unit secured to the housing and electrically connected to the ballast unit, and an additional electrical component electrically connected to the ballast unit and having a life span which decreases as an operating temperature of the additional electrical component increases, the heat sink system comprising:

a mounting arrangement configured to provide direct contact between the additional electrical component and an inside wall of the housing, the operating temperature of the additional electrical component being reduced by dissipating heat through the improved thermal contact.

10. The heat sink system as set forth in claim 9, wherein the additional electrical component is an electrolytic capacitor.

11. The heat sink system as set forth in claim 9, wherein the additional electrical component is mounted on the ballast unit.

12. The heat sink system as set forth in claim 9, wherein the light source system is a compact fluorescent light source system.

13. The heat sink system as set forth in claim 9, wherein a thermally conductive path is defined by the direct contact between the additional electrical component and the inside wall of the housing.

14. The heat sink system as set forth in claim 13, wherein the additional electrical component at least one of vents and absorbs heat via the inside wall of the housing and the direct contact.

15. A fluorescent light source system, comprising:

a base connector for receiving electrical power;

a substantially enclosed housing secured to the base connector;

a ballast unit secured within the housing and electrically connected to the base connector;

a fluorescent lamp unit secured to the housing and electrically connected to the ballast unit;

a plurality of electrical components, driven by the electrical power received by the base connector, both mechanically and electrically connected to the ballast unit, at least one of the electrical components having at least one heat absorbing/venting portion, the ballast unit being secured in the housing such that at least one of the heat absorbing/venting portions directly contacts an inside wall of the housing, the inside wall of the housing acting as the heat sink for the at least one electrical component whereby the operating temperature of the at least one electrical component is reduced by dissipating heat via the direct contact between the at least one heat absorbing/venting portion and the wall of the housing.

16. The fluorescent light source system as set forth in claim 15, wherein a life span of the at least one electrical component decreases as an operating temperature of the at least one electrical component increases.

17. The fluorescent light source system as set forth in claim 16, wherein the at least one electrical component is an electrolytic capacitor.

18. The fluorescent light source system as set forth in claim 15, wherein the fluorescent light source system is a compact fluorescent light source system.

19. The fluorescent light source system as set forth in claim 15, wherein the heat dissipated from the at least one electrical component includes at least one of heat generated by the at least one electrical component, heat generated by the other electrical components and absorbed by the at least one electrical component, and heat generated by the fluorescent lamp unit and absorbed by the at least one electrical component.

* * * * *